US008584420B2

(12) United States Patent
Ayers et al.

(10) Patent No.: US 8,584,420 B2
(45) Date of Patent: Nov. 19, 2013

(54) SPACER DEVICE FOR A CAVITY WALL

(75) Inventors: Charles William Jack Ayers, Bath (GB); Ronald John Pickersgill, Worcestershire (GB)

(73) Assignee: Surecav Limited, Dorset (GB)

( * ) Notice: Subject to any disclaimer, the term of this patent is extended or adjusted under 35 U.S.C. 154(b) by 1590 days.

(21) Appl. No.: 10/514,699

(22) PCT Filed: May 16, 2003

(86) PCT No.: PCT/GB03/02127
§ 371 (c)(1),
(2), (4) Date: Nov. 17, 2004

(87) PCT Pub. No.: WO03/097953
PCT Pub. Date: Nov. 27, 2003

(65) Prior Publication Data

US 2005/0223670 A1 Oct. 13, 2005

(30) Foreign Application Priority Data

May 17, 2002 (GB) ..... 0211371.0
Feb. 13, 2003 (GB) ..... 0303314.9

(51) Int. Cl.
*E04B 1/38* (2006.01)

(52) U.S. Cl.
USPC ..... 52/508; 52/383; 52/480

(58) Field of Classification Search
USPC ..... 52/169.5, 383, 379, 508, 506, 480, 479; 405/45
See application file for complete search history.

(56) References Cited

U.S. PATENT DOCUMENTS

| | | | | |
|---|---|---|---|---|
| 3,886,699 | A | 6/1975 | Bergmann, Jr. | 52/90 |
| 4,956,951 | A * | 9/1990 | Kannankeril | 52/169.5 |
| 5,044,821 | A * | 9/1991 | Johnsen | 405/50 |
| 5,052,161 | A * | 10/1991 | Whitacre | 52/385 |
| 5,692,348 | A | 12/1997 | Ambrosino | 52/169.5 |
| 5,816,008 | A * | 10/1998 | Hohmann | 52/565 |
| 5,860,259 | A * | 1/1999 | Laska | 52/302.3 |
| 6,131,353 | A * | 10/2000 | Egan | 52/408 |
| 6,170,211 | B1 * | 1/2001 | Boyce | 52/242 |
| 6,256,955 | B1 * | 7/2001 | Lolley et al. | 52/302.3 |
| 6,298,620 | B1 * | 10/2001 | Hatzinikolas | 52/302.1 |
| 6,684,579 | B2 * | 2/2004 | Brunson et al. | 52/169.5 |
| 6,691,472 | B2 * | 2/2004 | Hubert | 52/169.5 |
| 6,736,569 | B2 * | 5/2004 | Lee | 405/50 |
| 2001/0054263 | A1 | 12/2001 | Coulton | 52/199 |
| 2002/0139068 | A1 * | 10/2002 | Janesky | 52/169.5 |
| 2003/0200708 | A1 * | 10/2003 | Parker | 52/169.5 |

FOREIGN PATENT DOCUMENTS

| | | |
|---|---|---|
| DE | 7907495 | 11/1979 |
| EP | 0243079 | 10/1987 |
| GB | 2097037 | 10/1982 |
| GB | 2179078 | 2/1987 |
| GB | 2299817 | 10/1996 |

* cited by examiner

*Primary Examiner* — Jeanette E Chapman
*Assistant Examiner* — Daniel Kenny
(74) *Attorney, Agent, or Firm* — Gifford, Krass, Sprinkle, Anderson & Citkowski, P.C.

(57) ABSTRACT

A spacer device (30) for use in a cavity wall of a building to determine the separation of the building elements of the two leaves (19,20) of the wall during construction, comprising a support body (31) having a plurality of spaced projections (32) extending transversely of the general plane of the support body and, in use, across the cavity between the said two leaves, each projection having means for preventing or at least inhibiting the transfer of moisture at least in one direction from one end of the projection to the other.

4 Claims, 9 Drawing Sheets

SPACER DEVICE FOR A CAVITY WALL

RELATED APPLICATIONS

This application is a 371 of PCT/GB03/02127 filed May 16, 2003, which claims priority of United Kingdom Patent Applications 0303314.9 filed Feb. 13, 2003 and 0211371.0 filed May 17, 2002.

The present invention relates to improvements in or relating to a spacer device, a building structure incorporating such a spacer device, and a method for erecting a building. In particular, the invention relates to a spacer device for use in a cavity wall of a building structure to inhibit water penetration into the building.

Many modern buildings for habitation are now constructed using cavity walls. Cavity walls are generally more effective at improving thermal insulation and inhibiting moisture penetration compared to solid walls. Cavity walls consist of two walls or 'leaves' of masonry separated by a cavity or gap. Typically the walls are 100 mm thick separated by a 50 mm gap. The walls may be constructed from bricks, concrete blocks, hollow clay bricks, timber framing or natural stone, or a combination of these materials; the exterior wall or leaf is usually constructed from bricks. The exterior leaf and the interior leaf are tied together at spaced intervals with wall ties spanning the cavity.

For a cavity wall to effectively work as a moisture barrier, the cavity or gap should not be bridged in any way. Currently, this is a particular problem especially when mortar falls into the cavity during construction. Mortar can collect on one or more of the wall ties and/or collect at the base of the cavity thereby bridging the cavity and causing damp to reach an interior leaf of a cavity wall of a building.

The aim of the present invention is to reduce the aforementioned problems and to provide a spacer device for incorporating into a cavity wall of a building to reduce the likelihood of mortar falling into and bridging the cavity and to substantially inhibit moisture penetration to the inside of a building.

According to a first aspect of the present invention, there is provided a spacer device for use in a cavity wall of a building to determine the separation of the building elements of the two leaves of the wall during construction, comprising a support body having a plurality of spaced projections extending transversely of the general plane of the support body and, in use, across the cavity between the said two leaves, each projection having means for preventing or at least inhibiting the transfer of moisture at least in one direction from one end of the projection to the other.

Advantageously, the spacer device of the invention may improve air flow and heat insulation in a cavity wall and substantially reduces or prevents moisture penetration to an interior leaf of a cavity wall of a building.

Furthermore, the invention provides a cost-effective and efficient method for constructing improved cavity walls of buildings.

According to a second aspect of the present invention, there is provided a building structure incorporating a spacer device in a cavity wall in the building structure.

According to a third aspect of the present invention, there is provided a method of erecting a building having a cavity wall of two or more leaves comprising the steps of:

erecting part of one leaf of the cavity wall of the building;

securing to the erected part of the leaf of the cavity wall a spacer device in the form of a support body having a plurality of spaced projections extending transversely of the general plane of the support body, each projection having means for preventing or at least inhibiting transfer of moisture at least in one direction from one end of the projection to the other, and erecting at least part of an other leaf of the cavity wall of the building, in a position spaced from the said one leaf by a distance determined by the said spacer device.

The spacer device of the invention may be such that each projection of the support body has means for preventing or at least inhibiting the transfer of moisture in either direction along the length of the projection.

The means for preventing or at least inhibiting transfer of moisture may be located between proximal and distal ends of the projection. In one embodiment of the invention, such means may be located at a point between proximal and distal ends of the projection.

It is preferred that each projection of the support body of the spacer device has means to encourage release of moisture from the spacer device.

It is preferred that the means to prevent or inhibit moisture transfer from one end of the projection to the other and/or to encourage release of moisture from the device comprises the shape of the device. Each projection may have a cross-sectional shape including two downwardly converging lateral walls.

In a preferred embodiment of the invention, the plurality of spaced projections of the spacer device may be generally lozenge- or diamond-shaped. In this embodiment, when the spacer device is incorporated into a cavity wall of a building a ridge or edge formed by downwardly converging side portions of the diamond-shaped projections may form a "water drip" edge so that any moisture formed on the projections may be encouraged to separate from each projection. It is particularly desirable that the water drip edge of each projection is tapered toward its distal end so that moisture is directed towards the proximal end of the projection and away from an interior leaf of the cavity wall. In such an embodiment, the spacer device may prevent or at least inhibit transfer of moisture in one direction from the proximal end of each projection to the distal end.

In an alternative embodiment, the plurality of spaced projections of the spacer device may be generally half-lozenge- or half-diamond-shaped.

The generally diamond- or half-diamond-shaped projections may have a ridge or rib formed at or adjacent a distal end of each projection to prevent or inhibit the transfer of moisture to an interior leaf of a cavity wall of a building. The rib may extend at least partly circumferentially about each projection or, alternatively, the rib may preferably extend entirely circumferentially about each projection.

In one embodiment, the plurality of spaced projections of the spacer device may have a circular cross section.

Each projection may have a transversely extending ridge or rib formed so as to prevent or at least inhibit the transfer of moisture in, preferably in either direction along the length of the projection, and to encourage release of the moisture from the spacer device.

It is preferred that the ridge or rib formed on each of the projections is located at a point approximately equidistant between the proximal and distal ends of the projection. The rib may extend at least partly circumferentially about each projection or, alternatively, the rib may extend entirely circumferentially about each projection.

Alternatively, each projection of the support body of the spacer device may have a rib which extends along at least part of the axis of the projection.

Advantageously, the rib of each projection is designed to function as a "water bar" when the spacer device of the invention is incorporated into a cavity wall of a building structure to prevent or at least inhibit transfer of moisture, which may enter the cavity of the cavity wall, from one end of the projection to the other (that is in either direction) and to encourage the separation of moisture from the spacer device, thereby preventing or at least inhibiting moisture from penetrating an interior leaf of the cavity wall of the building.

In one embodiment, each projection of the support body may preferably have a lower portion or edge which tapers toward the distal end of the projection. In such an embodiment, when the spacer device of the invention is incorporated into a cavity wall of a building, the tapered portion or edge of each projection may downwardly direct moisture toward an exterior leaf of the cavity wall so as to encourage separation of the moisture from the spacer device. This is advantageous especially if any moisture remaining on the projections has not been separated from the spacer device by the rib on the projections.

It is preferred that the support body and the projections of the spacer device are integrally formed. Alternatively, the support body and the projections of the spacer device may be formed separately with the projections coupled to the support body by fixing means. The fixing means may comprise an adhesive, a fixing element, or formation of the support body with the projections by form engagement.

The support body of the spacer device is preferably laminar. Advantageously the spacer device of the invention is made of a substantially lightweight and non-degradable material. It is preferred that at least the support body of the spacer device is made of a plastics material, such as, for example polyethylene or polypropylene. It is particularly desired that the spacer device is made of a high density polyethylene material. The spacer device of the invention may be made by known techniques, such as, for example by moulding and extrusion. Advantageously, the spacer device is made of a recyclable material.

The support body of the spacer device may preferably have a layer of heat-insulating material applied onto a face thereof so that when the device is incorporated into a cavity wall of a building the heat insulation ability of the building may advantageously be enhanced. It is preferred that the layer of heat-insulating material is applied onto a face of the support body opposite the face from which the projections extend therefrom so that, in use, the heat insulating layer may abut an exterior leaf of the cavity wall.

The plurality of spaced projections extending transversely of the general plane of the support body may preferably be spaced in an equidistant array across the support body. In one embodiment, the projections may be spaced at 100 mm intervals across the support body of the spacer device. The projections are desirably longitudinal and they may each have a uniform length. It is preferred that the projections are substantially hollow.

The projections may be formed in a plurality of rows across the support body. It is preferred that each respective row of projections may be in an offset or staggered orientation. This is an advantage because moisture forming on the projections may drip directly to the ground without being substantially obstructed or hindered by lower rows of projections.

In this specification, the proximal end of the projection is the end located adjacent to the support body. The distal end of the projection is the end located remote from the support body. In an embodiment of the invention, when the spacer device is incorporated in a cavity wall of a building structure it is preferred that the distal ends of the plurality of projections abut an inner face of an interior leaf of the cavity wall. Consequently, in this embodiment the spaced projections span the entire width of the cavity or gap of the cavity wall. The leaves (i.e. the exterior wall and the interior wall) of a cavity wall are typically separated by a 50 mm gap; it is preferred that the length of each projection is up to 50 mm and particularly in the range of 35 mm to 50 mm.

It is preferred that the spacer device of the invention is secured in a cavity wall of a building by securing means which may desirably be in the form of a suitably shaped element such as an H-shaped connecting element.

A building structure incorporating the spacer device of the invention in a cavity wall of the building may incorporate a plurality of the spacer devices in the cavity wall. The spacer devices may be located at spaced intervals in the cavity wall and secured in the cavity wall by H-shaped connecting elements. Desirably, the plurality of the spacer devices are positioned in the cavity wall of the building in a plurality of rows and columns. Each respective spacer device in a column and/or row may be positioned between wall ties in the cavity wall.

Desirably, the spacer device of the invention is orientated in a cavity wall of a building so that the support body (or a heat-insulating layer which has been applied to substantially cover a face of the support body) of the spacer device is against an inner face of an exterior leaf of the cavity wall and the plurality of projections of the support body extend toward an interior leaf of the cavity wall of the building. It is preferred that the distal ends of the plurality of projections abut an inner face of the interior leaf of the cavity wall of the building. Desirably, the location of spacer devices to be secured in a cavity wall may be determined by the substantially vertical and horizontal spacing between the wall-ties in the cavity wall.

Use of the spacer device of the invention in a cavity wall of a building may advantageously result in less building materials being used for constructing the cavity wall. Consequently, improved cavity walls of buildings can be constructed at a cost-effective amount and at a more efficient rate.

The spacer device of the invention may also be incorporated into other parts of a building structure, for example, the flooring, ceilings, or roof of the building.

Embodiments of the invention shall now be described by way of example only with reference to the accompanying drawings, in which.

Figure 8A:
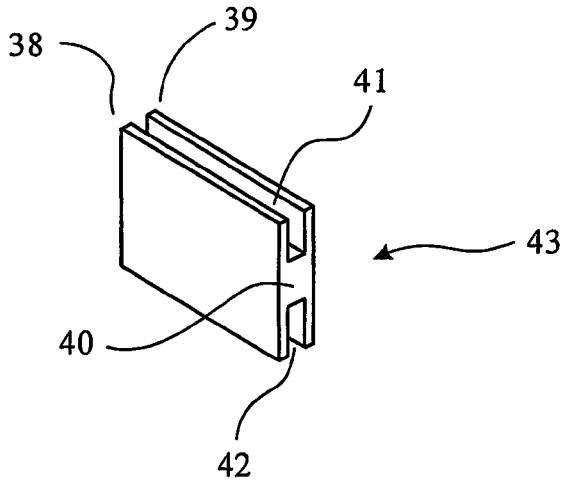
Figure 8B:
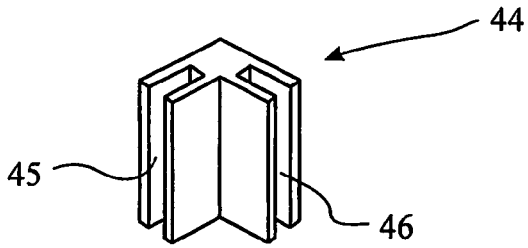
Figure 9:
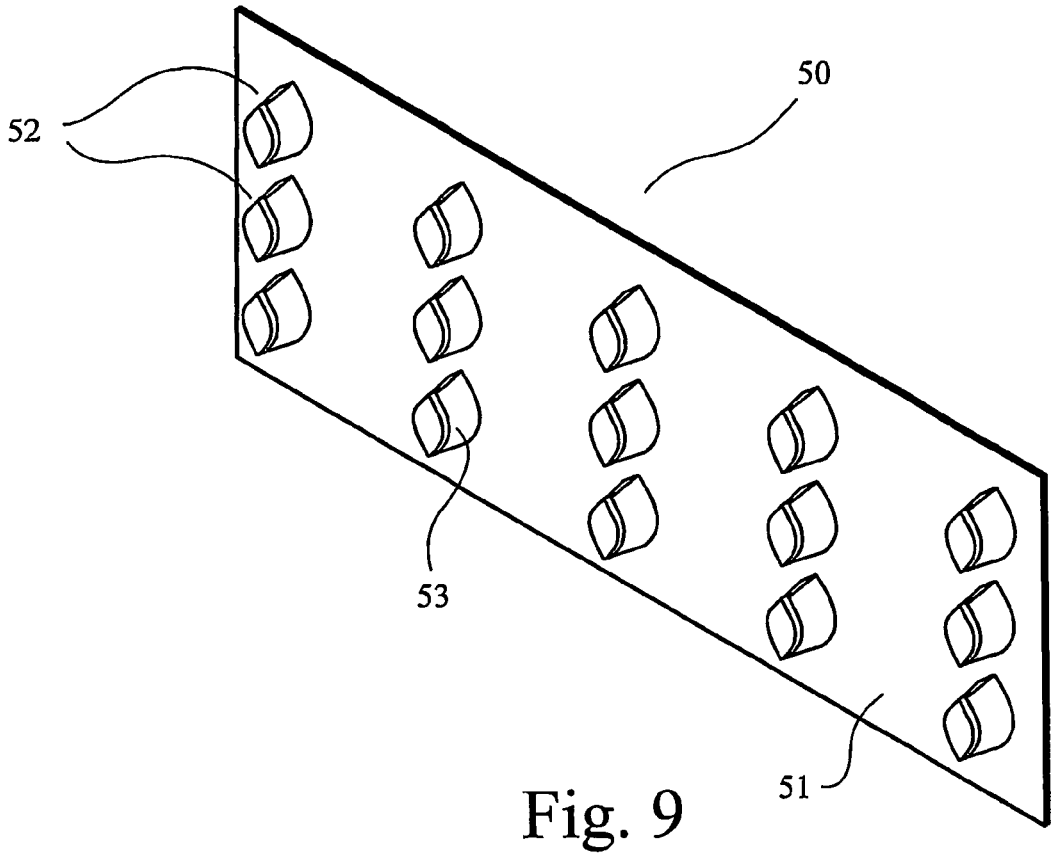
Figure 10:
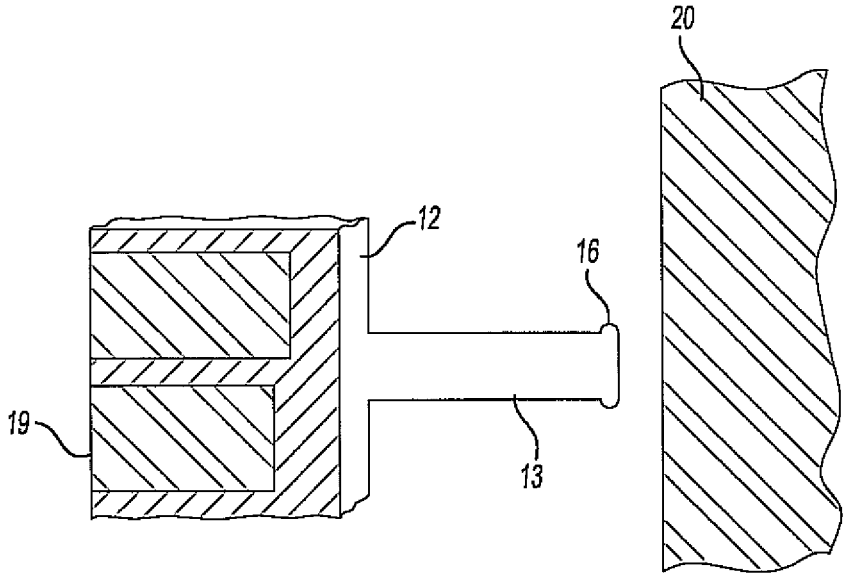
Figure 11:
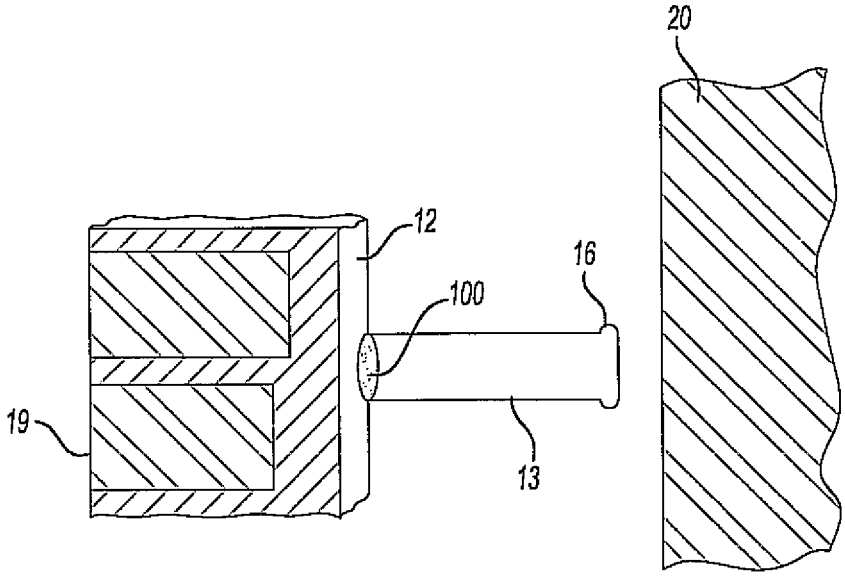
Figure 12:
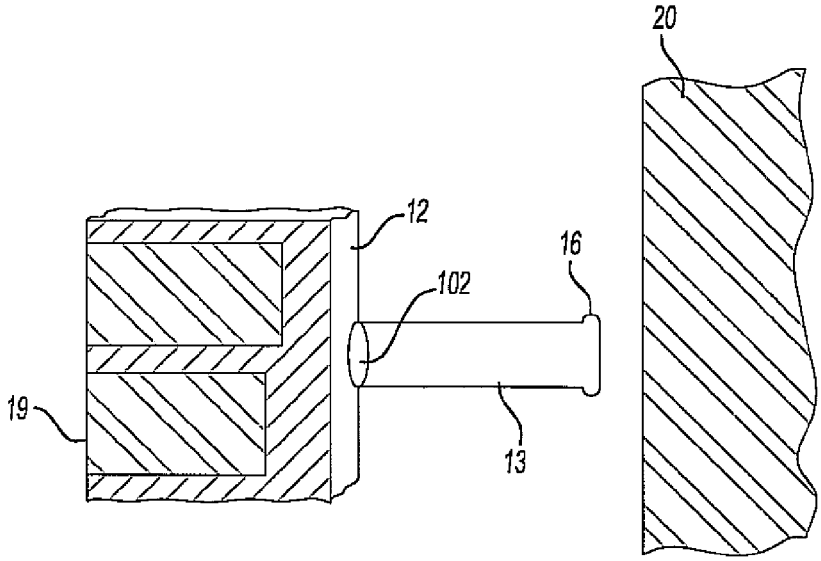
Figure 13:
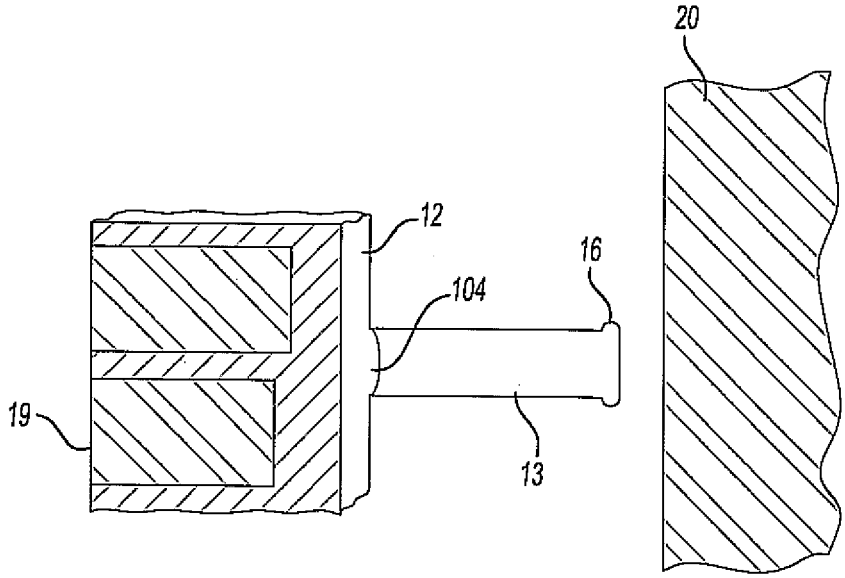

FIGS. 8(*a*) and (*b*) are perspective views of securing elements for securing a plurality of spacer devices in a cavity wall;

FIG. 9 is a perspective view of another spacer device embodying the invention;

FIG. 10 is a view illustrating an alternative projection;

FIG. 11 is a view similar to FIG. 10, but illustrating a modification thereof;

FIG. 12 is a view similar to FIG. 11, but showing a modification thereof; and FIG. 13 is a view similar to FIG. 11, but showing a modification thereof.

Figure 1:
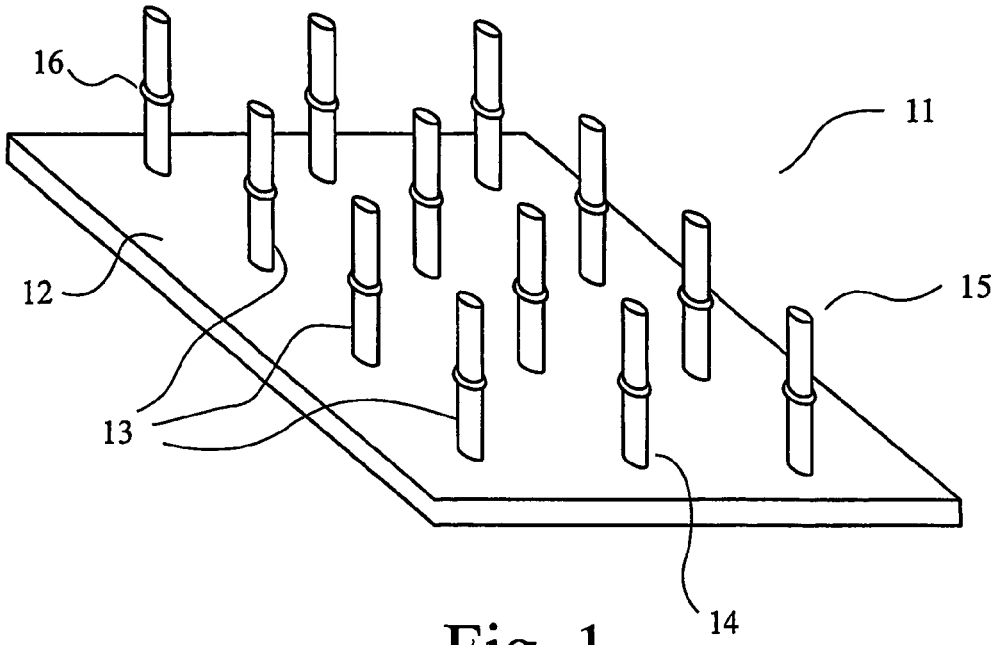
FIG. 1 is a perspective view of a spacer device embodying the invention.

Referring to FIG. 1, there is shown a spacer device embodying the invention generally designated by reference numeral 11. The spacer device 11 is integrally formed having a support body 12 with a plurality of projections 13 extending transversely from the plane of the support body 12. The support body 12 is a laminar sheet having dimensions of 1200 mm by 450 mm and a depth of 8 mm. The support body 12 and the projections 13 of the spacer device 11 are made from a plastics material which is polypropylene. The plurality of projections 13 are longitudinal and have a proximal end 14 located adjacent to an inner face of the support body 12 and a distal end 15 located away from the support body 12. Each of the projections 13 of the support body 12 is spaced from one another by a distance of 100 mm. The projections 13 have a circular cylindrical shape. A ridge or rib 16 is formed in each projection 13 at a point equidistant between the proximal and distal ends 14,15 of the projection 13. The ribs 16 extend entirely circumferentially about the projections 13. The spacer device 11 is primarily for use in a cavity wall of a building structure to prevent or at least inhibit water or moisture from penetrating the building (see FIG. 3).

Alternatively the rib 16 may be positioned at or adjacent the distal end of the projection 13 as shown in FIG. 10.

Figure 2:
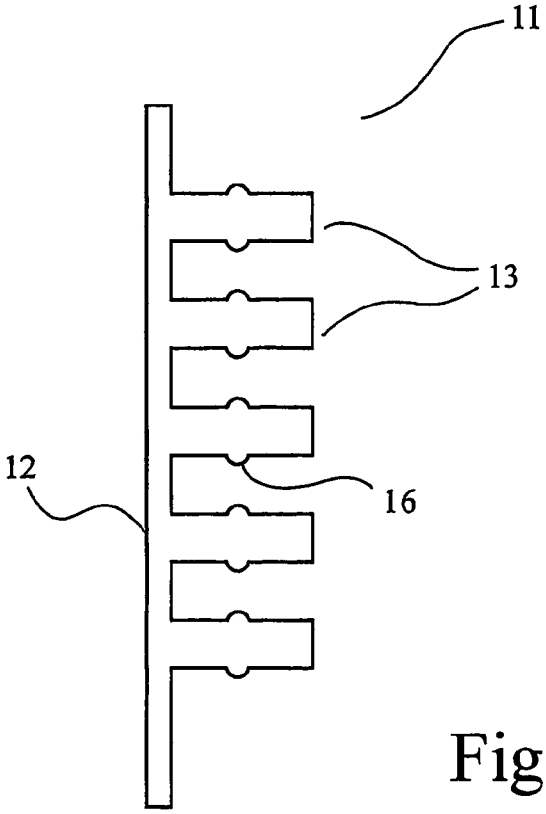
FIG. 2 is a side view of the spacer device of FIG. 1.

Referring to FIG. 2, there is shown a side view of the spacer device 11 having a support body 12 and a plurality of projections 13. The ribs 16 are at intermediate points along the length of the projections 13.

Alternatively, the projections 13 may be separately formed from the support body 12 and attached to the support body 12 by fixing means, such as an adhesive 100, as shown in FIG. 11, a fixing element 102, as shown in FIG. 12, or by formation of the support body with projections 104 by form engagement as shown in FIG. 13.

Figure 3:
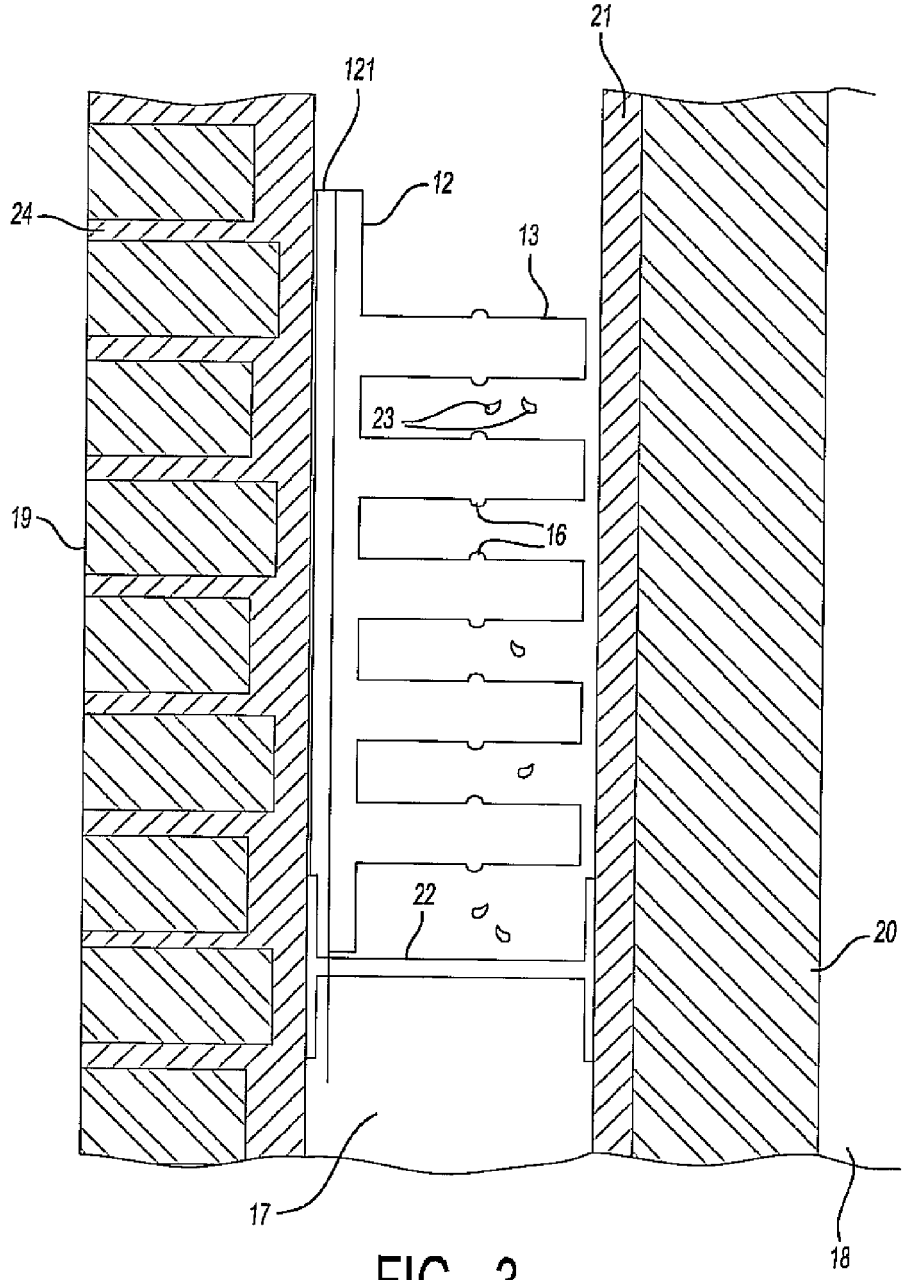
FIG. 3 is a sectional view of a cavity wall of a building incorporating the spacer device of FIG. 1.

Referring to FIG. 3, the spacer device 11 is incorporated in a cavity 17 of a cavity wall 18 of a building structure. The cavity wall 18 has an exterior wall 19 and an interior wall 20 and may optionally include a layer 21 of an insulating material on an inner face of the interior wall 20. A heat insulating layer 121 may also be provided between the support body 12 and the exterior wall 19. The exterior and interior walls 19,20 are constructed from bricks, although the walls 19,20 may also be constructed from concrete blocks, hollow clay bricks, timber framing or natural stone. The spacer device 11 is secured in the cavity 17 of the cavity wall 18 by an H-shaped connecting element 22. The support body 12 of the spacer device 11 lies against an inner face of the exterior wall 19 with the plurality of projections 13 extending toward an inner face of the interior wall 20. Advantageously, the support body 12 of the spacer device 11 may provide a barrier to hinder any loose mortar 24 from the exterior wall 19 from falling into the cavity 17 which could bridge the cavity 17 and cause water penetration into the interior wall 20 of the building. The ribs 16 located at mid-points along the projections serve to function as a "water bar" to prevent or hinder the penetration of water or moisture into the interior wall 20 of the building. Any water which enters the cavity 17 from the exterior wall 19 is channeled along the projections 13 to the ribs 16 whereupon further water penetration into the cavity 17 is prevented. The ribs 16 cause the water droplets 23 to drip downwardly from the projections 13 to the ground surface where weep holes (not shown) may be provided in the exterior wall 19 to drain the water from the cavity 17.

Figure 4:
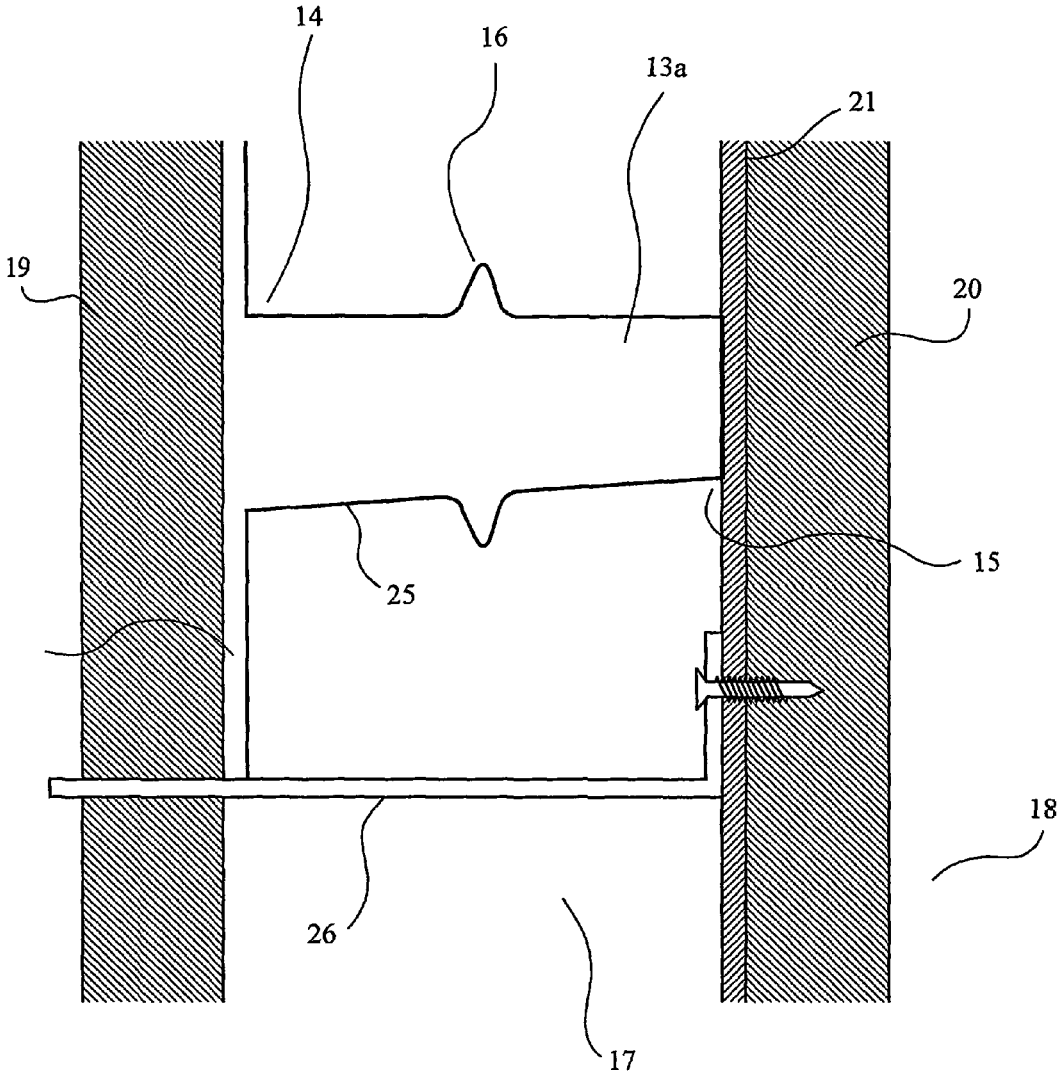
FIG. 4 is a side view of a projection of a spacer device embodying the invention in which the spacer device is incorporated in a cavity wall of a building.

Referring to FIG. 4, there is shown a single projection 13*a* of the spacer device 11 incorporated in a cavity 17 of a cavity wall 18 of a building structure. A distal end 15 of the projection 13*a* abuts an inner face of the interior wall 20. The projection 13*a* has a rib 16 at an intermediate point between the proximal and distal ends 14, 15 of the projection 13*a*. The rib 16 extends entirely circumferentially about the projection. The projection 13*a* has a bottom surface edge 25 which tapers toward its distal end 15. Advantageously, the tapered surface edge 25 and the rib 16 of the projection 13*a* can work synergistically to prevent or hinder the penetration of moisture into the interior wall 20 of the building and to encourage separation of the moisture from the spacer device 11. The tapered surface edge 25 directs moisture downwardly toward the exterior wall 19 causing the moisture to drip onto the exterior wall 19 and then toward the ground surface. A wall tie 26 ties the exterior wall 19 to the interior wall 20. The wall tie 26 is positioned below the spacer device 11. Wall ties are usually positioned in a cavity wall at spaced intervals, such as by a substantially vertically spaced distance of approximately 450 mm. A plurality of spacer devices embodying the invention are desirably secured in a cavity wall at spaced intervals between spaced wall ties.

Figure 5:
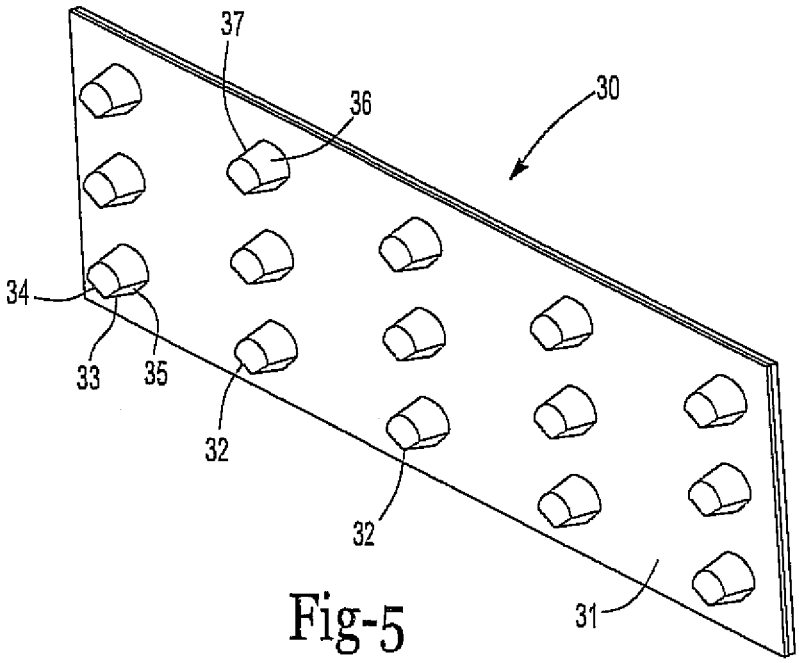
FIG. 5 is a perspective view of another spacer device embodying the invention.

Referring to FIG. 5, there is shown another spacer device embodying the invention generally designated by reference numeral 30. The spacer device 30 is integrally formed having a laminar support body 31 with a plurality of hollow projections 32 extending transversely from the plane of the body 31. The plurality of projections 32 are spaced across a front face of the body 31 and are formed into three rows and five columns wherein each respective column has three projections. A rear face (not shown) of the support body 31 has a layer of heat-insulating material, typically rock-wool, applied to it by suitable means, such as, for example, an adhesive. The laminar support body 31 has dimensions of 1200 mm×450 mm and a depth of 3 mm. Each projection in each respective row is spaced by a distance of approximately 260 mm (measured between the longitudinal axes of the projections); each projection in each respective column is spaced by a distance of approximately 140 mm.

Figure 6:
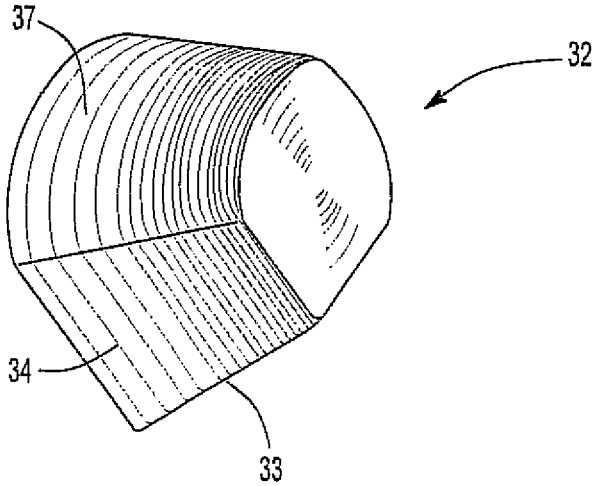
FIG. 6 is a perspective view of a projection of the spacer device of FIG. 5.
Figure 7:
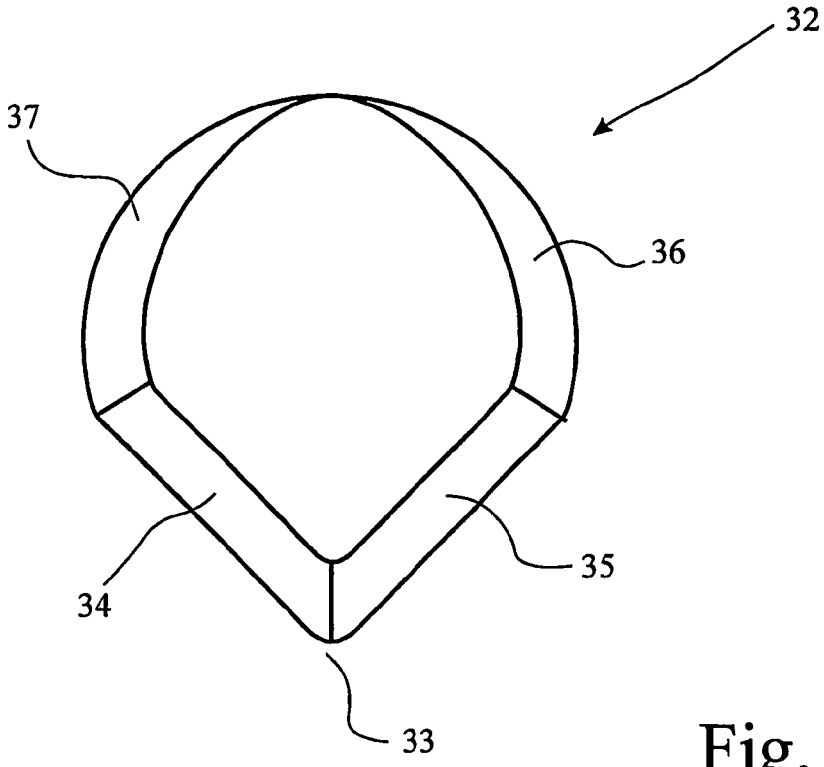
FIG. 7 is an end view of the projection of FIG. 6.

Referring to FIGS. 5, 6 and 7, the projections 32 have a generally half-diamond shape in which a bottom ridge or edge 33 defined by downwardly converging side walls 34, 35 allow water droplets or moisture to separate from the projections when the spacer device is installed in a cavity wall. An upper portion of each projection 32 has a substantially circular cross section so that any moisture forming or collecting on outwardly diverging side walls 36, 37 of this part of the projection may induce the water droplets to roll down onto the side walls 34,35 which are steeply angled relative to the axis of the projection. The steep gradient of the walls 34, 35 causes the water droplets to travel down the walls relatively quickly and to be separated from the projection 32 by the ridge 33.

A plurality of the spacer devices may be installed in a cavity wall of a building in a plurality of rows and columns. Typically, wall ties are located in a cavity wall at regular spaced intervals. The substantially horizontal spacing between adjacent wall ties is usually about 1200 mm and the substantially vertical spacing between adjacent wall ties is usually about 450 mm. These measurements correspond approximately to the dimensions of the spacer device embodying the invention so that the device may be positioned in a cavity wall between spaced wall ties. Hence, the wall ties will normally be located at corner regions of the spacer device.

Referring to FIGS. 8(*a*) and (*b*) respectively, there is shown a H-shaped element 43 for connecting a spacer device to another spacer device in a cavity wall and a corner piece element 44 for connecting a spacer device in a cavity wall to a spacer device in an adjoining cavity wall. The H-shaped element has two longitudinal parallel walls 38, 39 joined together at a middle region thereof by an integral longitudinal member 40 so as to define U-shaped channels 41, 42 each of which can receive a part of the laminar body of a spacer device. In this way, one spacer device can be connected to another device to create a sufficiently stable structure of spacer devices in a cavity wall. Desirably, a plurality of H-shaped elements 43 may be engaged between the longitudinally extending edge (which will usually be substantially horizontal) of the support body of one spacer device and the support body of another spacer device. The corner-piece element 44 defines U-shaped channels 45, 46 which are orientated substantially transverse to each other so that they may engage with at least a periphery of the spacer devices in adjoining cavity walls whereby to secure such spacer devices in a corner region of the cavity walls.

Referring to FIG. 9, there is shown another spacer device embodying the invention generally designated by reference numeral 50. The spacer device 50 has a lamina support body 51 with a plurality of hollow projections 52 extending transversely from the plane of the body 51. Each of the projections 52 has a generally diamond or lozenge shape and a circumferentially extending rib 53 is located at a distal end to prevent or reduce any moisture penetration to an inner leaf of a cavity wall of a building.

A plurality of spacer devices inter-connected in a cavity wall of a building may effectively improve air circulation in the cavity wall and provide a barrier to prevent or hinder moisture penetration within the cavity wall.

The present invention also discloses a method of erecting a building having a cavity wall of two or more leaves comprising the steps of: erecting part of one leaf of the cavity wall of the building; securing to the erected part of the leaf of the cavity wall a spacer device; and erecting at least part of an other leaf of the cavity wall of the building, in a position spaced from the said one leaf by a distance determined by the said spacer device. The spacer device is orientated in the cavity wall of the building so that the support body of the spacer device is against an inner face of an exterior leaf of the cavity wall and the plurality of projections of the support body extend toward an interior leaf of the cavity wall of the building. The spacer device is orientated so that distal ends of the plurality of projections abut an inner face of the interior leaf of the cavity wall of the building.

A plurality of the spacer devices are positioned in the cavity wall of the building in a plurality of rows and columns. The spacer device is adapted to be positioned, in use, so as to be supported and located by wall-ties present in the cavity wall. The plurality of the spacer devices are secured in the cavity wall of the building by H-shaped connecting elements.

The invention claimed is:

1. A method of erecting a building having a vertically extending cavity wall of two or more leaves comprising the steps of:

erecting part of one leaf of the cavity wall of the building;

securing to the erected part of the leaf of the cavity wall a spacer device which determines a separation of building elements of the two leaves of the vertically extending wall during construction, the wall spacer comprising a support body having a plurality of spaced projections extending horizontally therefrom and vertically spaced apart from each other across the cavity between said two leaves, each projection having means for preventing or at least inhibiting transfer of moisture at least in one direction from one end of the projection to the other;

erecting at least part of an other leaf of the cavity wall of the building, in a position spaced from the said one leaf by a distance determined by the said spacer device; and wherein the spacer device is orientated in the cavity wall of the building so that a support body of the spacer device is against an inner face of an exterior leaf of the cavity wall and a plurality of projections of the support body extend toward an interior leaf of the cavity wall of the building.

2. A method according to claim 1, wherein the spacer device is orientated so that distal ends of the plurality of projections abut an inner face of the interior leaf of the cavity wall of the building.

3. A method according to claim 1, wherein a plurality of the spacer devices are positioned in the cavity wall of the building in a plurality of rows and columns.

4. A method according to claim 3, wherein the spacer device is adapted to be positioned, in use, so as to be supported and located by wall-ties present in the cavity wall.

* * * * *